US006879791B2

(12) United States Patent
Nakahara

(10) Patent No.: US 6,879,791 B2
(45) Date of Patent: Apr. 12, 2005

(54) METHOD OF POSITIONING IMAGE FORMING MEANS AND POSITIONING JIG FOR THE SAME

(75) Inventor: Tomotoshi Nakahara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 22 days.

(21) Appl. No.: 10/382,888

(22) Filed: Mar. 7, 2003

(65) Prior Publication Data

US 2003/0185586 A1 Oct. 2, 2003

(30) Foreign Application Priority Data

Mar. 8, 2002 (JP) ..... 2002-063230

(51) Int. Cl.[7] ..... G03G 15/00
(52) U.S. Cl. ..... 399/110; 399/117; 399/119
(58) Field of Search ..... 399/110–113, 117, 399/119, 299, 223; 347/138, 152, 245, 263

(56) References Cited

U.S. PATENT DOCUMENTS

| | | | | |
|---|---|---|---|---|
| 5,258,813 A | | 11/1993 | Nakahara et al. | |
| 5,280,362 A | | 1/1994 | Noguchi | |
| 5,475,484 A | * | 12/1995 | Kimura | 399/130 |
| 5,541,029 A | | 7/1996 | Iwata et al. | |
| 5,552,857 A | * | 9/1996 | Ishikawa | 399/113 |
| 5,640,229 A | | 6/1997 | Nakahara | |
| 5,848,329 A | * | 12/1998 | Aoyama et al. | 399/113 |
| 5,869,213 A | | 2/1999 | Iwata et al. | |
| 6,061,537 A | * | 5/2000 | Nakajima et al. | 399/107 |
| 6,393,241 B1 | | 5/2002 | Matsumoto et al. | |
| 6,493,532 B2 | | 12/2002 | Nakahara et al. | |
| 6,501,913 B2 | | 12/2002 | Hattori et al. | |
| 6,507,720 B2 | | 1/2003 | Kabumoto et al. | |
| 6,567,637 B2 | | 5/2003 | Yanagisawa et al. | |
| 6,567,643 B2 | | 5/2003 | Yasui et al. | |
| 2002/0044791 A1 | * | 4/2002 | Shinkai et al. | 399/112 |

FOREIGN PATENT DOCUMENTS

| | | | | |
|---|---|---|---|---|
| JP | 01170958 A | * | 7/1989 | G03G/15/01 |
| JP | 7-140787 | | 6/1995 | |
| JP | 09114173 A | * | 5/1997 | G03G/15/01 |

OTHER PUBLICATIONS

U.S. Appl. No. 10/456,583, filed Jun. 9, 2003, Fujishiro et al.
U.S. Appl. No. 10/660,571, filed Sep. 12, 2003, Noguchi et al.
U.S. Appl. No. 10/726,665, filed Dec. 4, 2003, Hattori.
U.S. Appl. No. 09/848,320, filed May 4, 2001, Yanagisawa et al.
U.S. Appl. No. 09/873,245, filed Jun. 5, 2001, Mae.
U.S. Appl. No. 09/903,787, filed Jul. 13, 2001, Sato et al.
U.S. Appl. No. 09/963,644, filed Sep. 27, 2001, Matsumoto et al.
U.S. Appl. No. 10/073,296, filed Feb. 13, 2002, Fujishiro.
U.S. Appl. No. 10/145,899, filed May 16, 2002, Fujishiro et al.

* cited by examiner

*Primary Examiner*—Robert Beatty
(74) *Attorney, Agent, or Firm*—Oblon, Spivak, McClelland, Maier & Neustadt, P.C.

(57) ABSTRACT

An image forming means positioning method of the present invention positions a plurality of image carrier units and a plurality of developing units by mounting them between a pair of side walls included in an image forming apparatus. The method includes the steps of mounting a positioning jig between the side walls to thereby position a plurality of unit support members, affixing the unit support members to one of the side walls, removing the positioning jig, and causing the unit support members to support the image carrier units and developing unit.

20 Claims, 9 Drawing Sheets

(REAR)

METHOD OF POSITIONING IMAGE FORMING MEANS AND POSITIONING JIG FOR THE SAME

BACKGROUND OF THE INVENTION

1. Field of the Invention

The present invention relates to a copier, printer, facsimile apparatus or similar image forming apparatus. More particularly, the present invention relates to a method of positioning image forming means for forming toner images on an image carrier one after another by repeating development, image transfer, cleaning and so forth, and a positioning jig for practicing the same.

2. Description of the Background Art

One of conventional image forming apparatuses is implemented as a tandem color printer in which four image forming means assigned to yellow, magenta, cyan and black and each including an image carrier unit and a developing unit are arranged side by side. In such a color printer, toner images of different colors are respectively formed on image carriers included in the image forming means and directly transferred to a paper sheet, OHP (OverHead Projector) film or similar recording medium one above the other, completing a composite color image on the recording medium. Alternatively, the toner images may be transferred from the drums to the recording medium by way of an intermediate image transfer belt or body.

A problem with the color printer described above is that the dislocation of any one of the image forming means directly translates into a color shift. Another problem is that if an image carrier unit and a developing unit, for example, included in each image forming means are dislocated relative to each other, then a gap for development between the two units becomes irregular and results in irregular tonality. In addition, not only image quality is lowered, but also toner is caused to fly about.

In light of the above, Japanese Patent Laid-Open Publication No. 7-175322, for example, proposes to mount a plurality of developing units to a single plate and bias each developing unit with a particular spring such that a developing roller thereof adjoins an image carrier associated therewith. This proposal is directed toward a constant gap for development. However, when power is transmitted from a drive source to the developing unit, the developing unit oscillates and causes the above gap to vary. Should the bias of the spring be intensified to prevent the developing unit from oscillating, the developing unit would be difficult to mount or dismount.

Technologies relating to the present invention are disclosed in, e.g., Japanese Patent Laid-Open Publication No. 7-140787.

SUMMARY OF THE INVENTION

It is an object of the present invention to provide an image forming means positioning method capable of accurately positioning image forming means, particularly image carrier units and developing units included therein, to thereby insure accurate gaps for development, and a jig for practicing the same.

It is another object of the present invention to provide an image forming means positioning method implementing an easy procedure for positioning unit support members, which are to support the image carrier units and developing units, and a jig for practicing the same.

It is still another object of the present invention to provide an image forming means positioning method capable of further accurately positioning the unit support members on a side wall, and a jig for practicing the same.

It is yet another object of the present invention to provide an image forming means positioning method making it needless to accurately position all of the unit support members on the side wall to thereby promote easy fabrication of the side wall, and a jig for practicing the same.

It is a further object of the present invention to provide an image forming apparatus allowing its image carrier units and developing units to be surely positioned by any one of the methods and jigs stated above.

In accordance with the present invention, an image forming means positioning method positions a plurality of image carrier units and a plurality of developing units by mounting them between a pair of side walls included in an image forming apparatus. The method includes the steps of mounting a positioning jig between the side walls to thereby position a plurality of unit support members, affixing the unit support members to one of the side walls, removing the positioning jig, and causing the unit support members to support the image carrier units and developing unit.

Also, in accordance with the present invention, a positioning jig positions a plurality of image forming means each including a respective image carrier unit and a respective developing unit. After the positioning jig has been mounted between a pair of side walls disposed in an image forming apparatus face to face, it positions a plurality of unit support members to be temporarily affixed to one of the side walls. The jig is then removed from the side walls after the unit support members have been fully affixed to the one side wall, but before the image carrier units and developing units are mounted to the unit support members.

BRIEF DESCRIPTION OF THE DRAWINGS

The above and other objects, features and advantages will become more apparent from the following detailed description taken with the accompanying drawings in which.

DESCRIPTION OF THE PREFERRED EMBODIMENT

Figure 1:
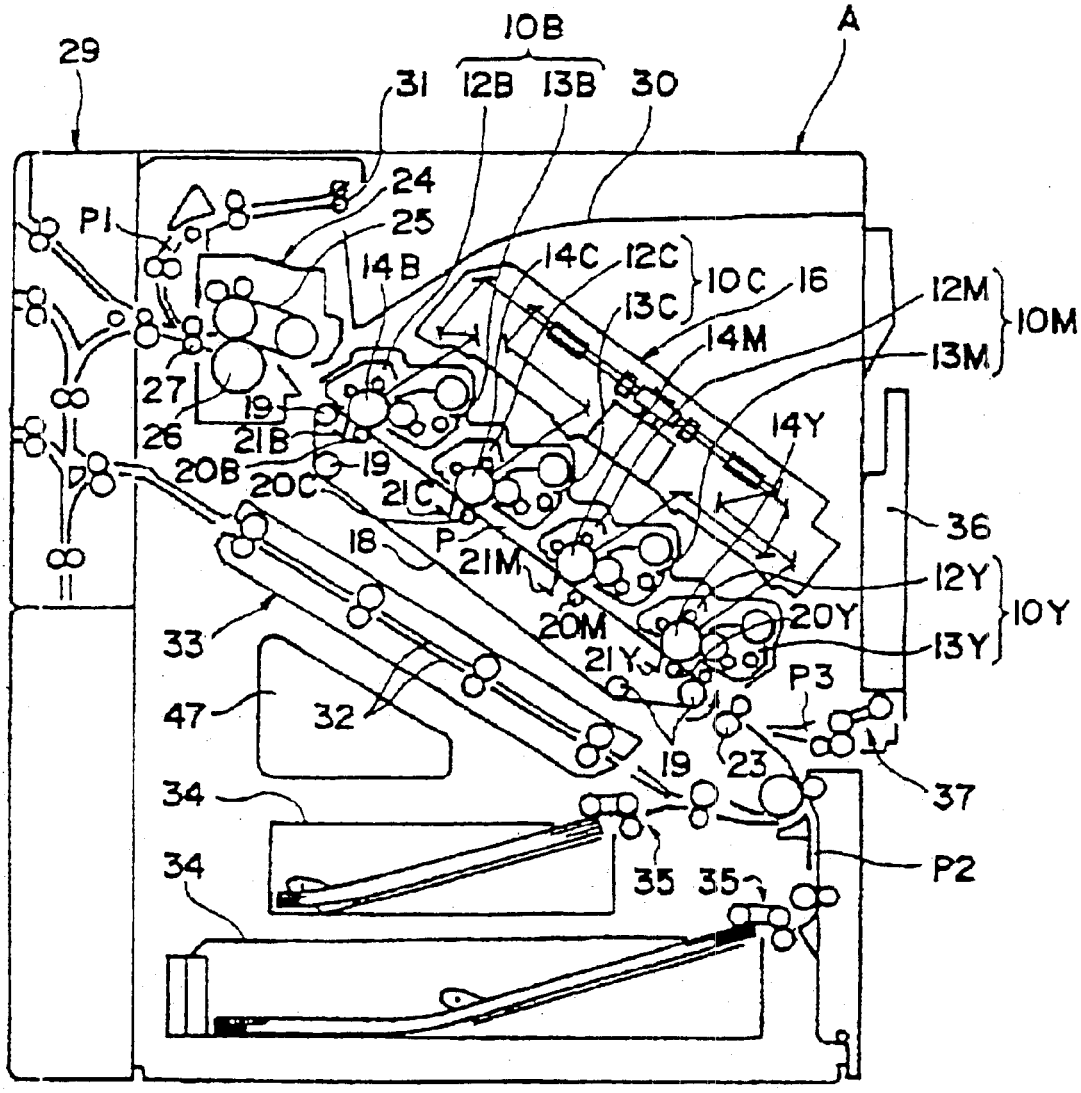
FIG. 1 shows an image forming apparatus whose image forming means are positioned by a method and a jig embodying the present invention.

Referring to FIG. 1 of the drawings, an image forming apparatus to which a preferred embodiment of the present invention is applied is shown and implemented as a tandem color printer by way of example. As shown, the tandem color printer includes a printer body A in which a sheet path P obliquely extends from the bottom right toward the top left, as viewed in FIG. 1.

Yellow (Y), magenta (M), cyan (C) and black (B) image forming means 10Y, 10M, 10C and 10B are arranged side by side along the oblique sheet path P. The image forming means 10Y, 10M, 10C and 10B are respectively made up of drum units or image carrier units 12Y, 12M, 12C and 12B and developing units 13Y, 13M, 13C and 13B, and each is removably mounted to the printer body A. The drum units 12Y, 12M, 12C and 12B include photoconductive drums or image carriers 14Y, 14M, 14C and 14B, respectively.

An optical writing unit 16 is positioned above the image forming means 10Y through 10B and also inclined in parallel to the image forming means 10Y through 10B.

An endless belt or sheet conveyor 18 faces the image forming means 10Y through 10B with the intermediary of the sheet path P and is passed over four rollers 19. Part of the belt 18 extends along the sheet path P in contact with the drums 14Y through 14B. A drive mechanism, not shown, causes the belt 18 to move counterclockwise, as viewed in FIG. 1.

Backup rollers 20Y, 20M, 20C and 20B and image transfer brushes 21Y, 21M, 21C and 21B are held in contact with the inner surface of the belt 18 and respectively assigned to the drums 14Y, 14M, 14C and 14B. The backup rollers 20Y through 20B press the belt 18 and a sheet or recording medium against the drums 14Y through 14B, respectively. Power supplies, not shown, each apply an image transfer bias to one of the image transfer brushes 21Y through 21B. The image transfer brushes 21Y through 21B may, of course, be replaced with non-contact type chargers.

A registration roller pair 23 and a fixing unit 24 are positioned on the sheet path P at the upstream side and downstream side of the belt 18, respectively. The fixing unit 24 is made up of an fixing belt 25, a press roller 26 pressed against the fixing belt 25, and an outlet roller pair 27.

A sheet turning unit 29 is mounted on the printer body A at a position downstream of the fixing unit 24. The sheet turning unit 29 simply drives a sheet out of the printer body A or turns the sheet before driving it out or returns the sheet into the printer body A.

A discharge path P1 branches off the sheet path P at a position downstream of the fixing unit 24. A discharge roller pair 31 is positioned at the end of the discharge path P1 for driving a sheet out of the printer body A onto a stacking portion 30, which is positioned on the top of the printer body A.

A refeeding unit 33 is positioned below the belt 18 and inclined in the direction in which the belt 18 extends. The refeeding unit 33 includes a pair of guides 32 for guiding a sheet returned from the sheet turning unit 29, so that the sheet is again fed from the refeeding unit 33.

Two sheet cassettes 34 are positioned one above the other below the refeeding unit 33, and each is loaded with a stack of paper sheets, OHP (OverHead Projector) films or similar recording media of a particular size (sheets hereinafter). A sheet feeding device 35 assigned to each sheet cassette 34 pays out the top sheet while separating it from the underlying sheets.

A feed path P2 is arranged at the right-hand side of the sheet feeding devices 35, as viewed in FIG. 1. The feed path P2 delivers the sheet fed from either one of the sheet cassettes 35 or the refeeding unit 33 to the registration roller pair 23, which is positioned on the sheet path P.

A manual feed tray 36 is foldably mounted on the right wall of the printer body A, as viewed in FIG. 1. A sheet feeding device 37 feeds sheets stacked on the manual feed tray 36 one by one. A manual feed path P3 extends from the manual feed tray 36 to the registration roller pair 23.

In operation, one of the sheet feeding devices 35 is driven in accordance with a signal sent from, e.g., a host and pays out one sheet from the associated sheet cassette 34 at a time. The sheet so paid out is delivered to the registration roller pair 23 via the feed path P2 and temporarily stopped thereby. This is also true with a sheet fed from the manual feed tray 36 except that the sheet feeding device 37 and feed path P3 are substituted for the sheet feeding device 35 and sheet path P2, respectively.

In the image forming means 10Y through 10B, the drums 14Y through 14B are rotated to form a Y, an M, a C and a B toner image thereon, respectively. At the same time, a drive motor, not shown, drives one of the rollers 19 for thereby causing the belt 18 to turn; the other rollers 19 are driven by the belt 18.

The registration roller pair 23 starts conveying the sheet into the sheet path P in synchronism with the rotation of the drums 14Y through 14B. The belt 18 conveys the sheet thus entered the sheet path P via nips between the belt 18 and the consecutive drums 14Y through 14B. At this instant, image transfer biases are applied to the brushes 21Y through 21B for thereby sequentially transferring the toner images from the drums 14Y through 14B to the sheet one above the other. As a result, a full-color toner image is completed on the sheet.

The sheet carrying the full-color toner image thereon is introduced into the fixing unit 24. After the toner image has been fixed on the sheet by the fixing unit 24, the sheet or print is driven out by the outlet roller pair 27. When such prints should be stacked face down, a path selector, not shown, selects the discharge path P1. As a result, print are sequentially driven out of the printer body A via the discharge path P1 and discharge roller pair 31 and then stacked on the stacking portion 30. On the other hand, when prints should be stacked face up, a path selector, not shown, is so positioned as to guide the prints to the turning unit 29.

In a duplex print mode, the path selector, not shown, is so positioned as to steer the print carrying the toner image on its one side toward the turning unit 29. The print entered the turning unit 29 is turned, then introduced into the refeeding unit 33, and then again fed until it has been stopped by the registration roller pair 23 on the feed path P2. The registration roller pair 23 again conveys the one-sided print to the nips between the drums 14Y through 14B and the belt 18, so that other toner images are sequentially transferred from the drums 14Y through 14B to the other side of the same print one above the other. After the resulting full-color toner image has been fixed on the sheet by the fixing unit 24, the print or duplex print may be stacked on the stacking portion 30 via the discharge path P1 and discharge roller pair 31.

Figure 2:
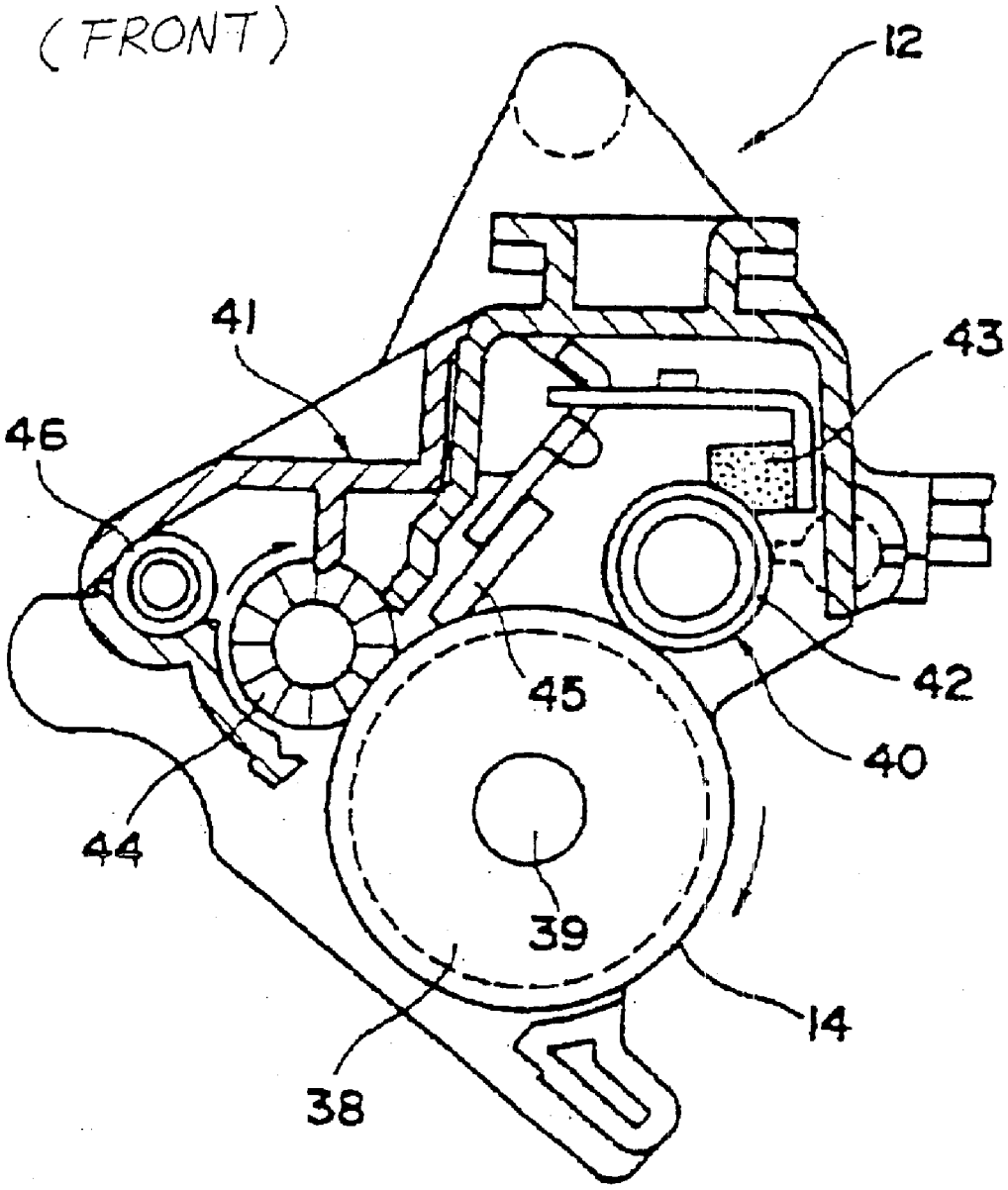
FIG. 2 shows one of image carrier units included in the image forming apparatus in detail.
Figure 3:
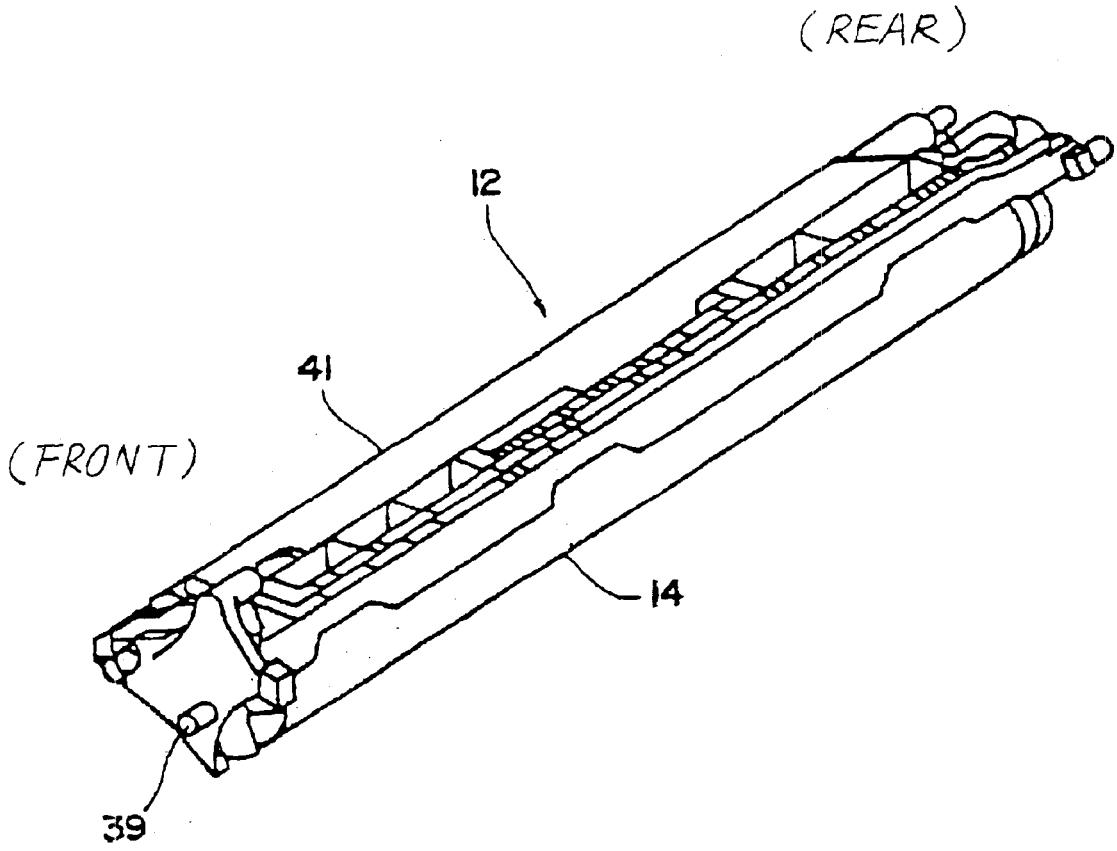
FIG. 3 is a perspective view showing the image carrier unit of FIG. 2.

The image forming means 10Y through 10B are identical in configuration except for the color of toner stored therein. One of such image forming means, labeled 10, will be described-hereinafter in detail. As shown in FIGS. 2 and 3, the drum unit 12 (12Y, 12M, 12C or 12B) of the image forming means 10 includes a charging device 40 and a drum cleaning device 41 arranged around the drum 14 (14Y, 14M, 14C or 14B).

Flanges are mounted on the front and rear ends of the drum 14. The rear flange is formed with a center hole while the front flange is formed with a drum shaft 39 protruding outward. The drum shaft 39 is aligned with the center hole of the rear flange in the axial direction of the drum 14.

The charging device 40 includes a charge roller or charging member 42 adjoining the drum 14. The charge roller 42 uniformly charges the surface of the drum 14 by being applied with a bias. A cleaner 43 formed of, e.g., sponge is held in contact with the charge roller 42. The charge roller 42 may, of course, be replaced with a conventional non-contact type of charger.

The cleaning device 41 includes a rotatable fur brush 44 held in contact with the drum 14. A cleaning blade 45 formed of, e.g., polyurethane has its edge pressed against the drum 14. The reference numeral 46 designates a screw for collecting toner removed from the drum 14. More specifically, the fur brush 44 is rotated in a direction counter to the direction of rotation of the drum 14 in order to remove toner left on the drum 14 after image transfer. Subsequently, the cleaning blade 45 removes the toner that the fur brush 44 failed to remove. The toner so collected by the fur brush 44 and cleaning blade 45 is conveyed by the screw 46 out of the image forming means 10. Such toner is collected in a waste toner bottle 47 (FIG. 1) via a collection path not shown.

In the illustrative embodiment, the developing unit 13 (13Y, 13M, 13C or 13B) of the image forming means 10 stores a two-ingredient type developer made up of magnetic carrier grains and nonmagnetic Y, M, C or B toner grains although the developer may be replaced with toner.

In each image forming means 10, the charging device 40 uniformly charges the surface of the drum 14 rotating clockwise, as viewed in FIG. 2. The optical writing unit 16 scans the charged surface of the drum 14 with a light beam in accordance with image data to thereby form a latent image. The developing unit 13 develops the latent image with the toner for thereby producing a corresponding toner image on the drum 14. More specifically, a Y, an M, a C and a B toner image are formed on the drums 14Y, 14M, 14C and 14B, respectively.

Hereinafter will be described a structure for positioning the image forming means 10. The color printer described above includes a front and a rear side wall implemented by sheet metals. The front and rear side walls support the image forming means 10, optical writing unit 16, drums 18, refeeding unit 33 and so forth therebetween.

Figure 4:
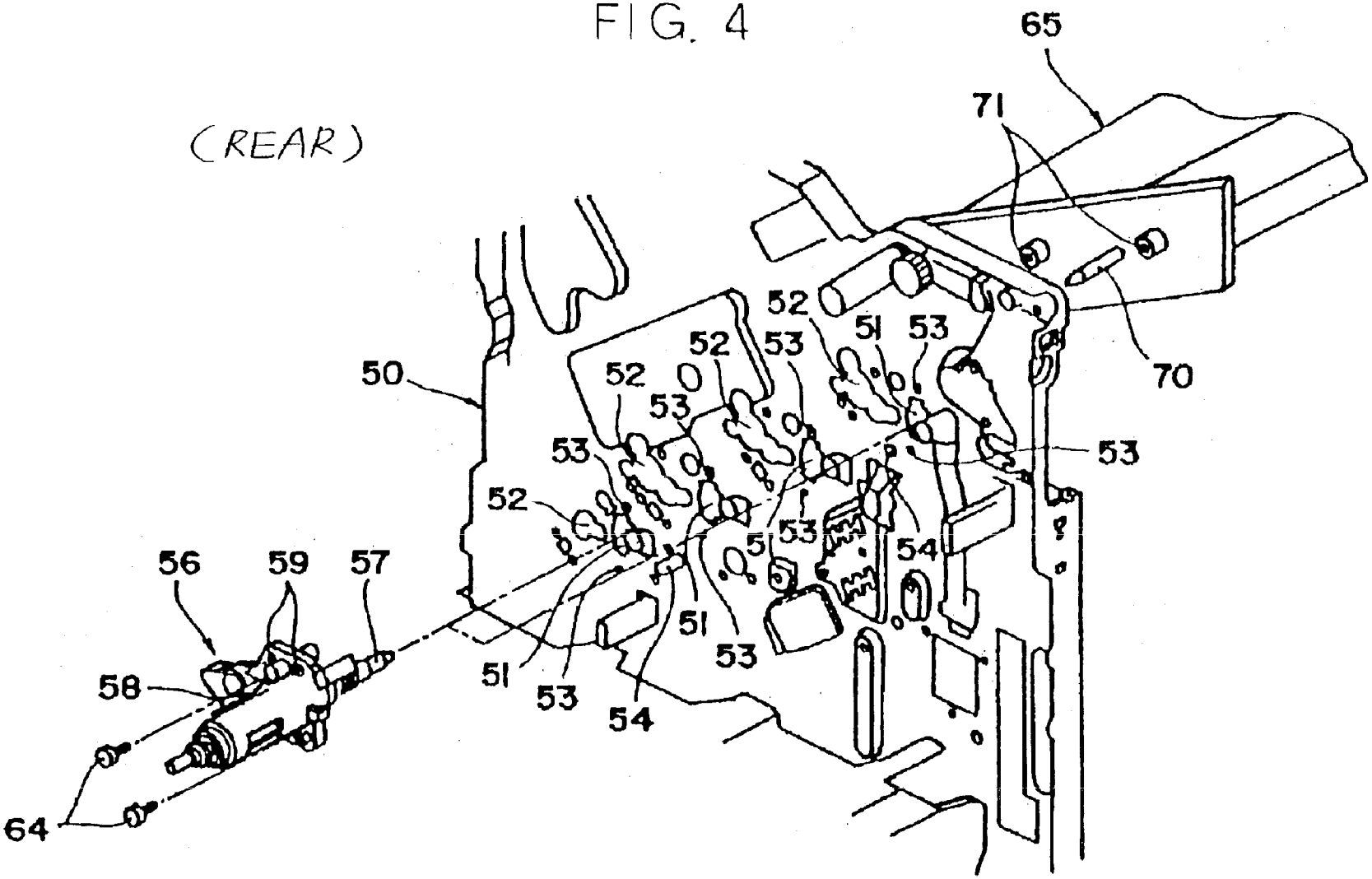
FIG. 4 is an exploded perspective view showing a rear side wall included in the image forming apparatus together with a unit support member and the positioning jig, as seen from the outside.

More specifically, as shown in FIG. 4, the rear side wall 50 is formed with four pairs of holes 51 and 52 at preselected intervals on an oblique line. A plurality of screw holes 53 are formed in the rear side wall 50 around each pair of holes 51 and 52. Two rear reference pin holes 54 are positioned below the four pairs of holes 51 and 52.

Figure 5:
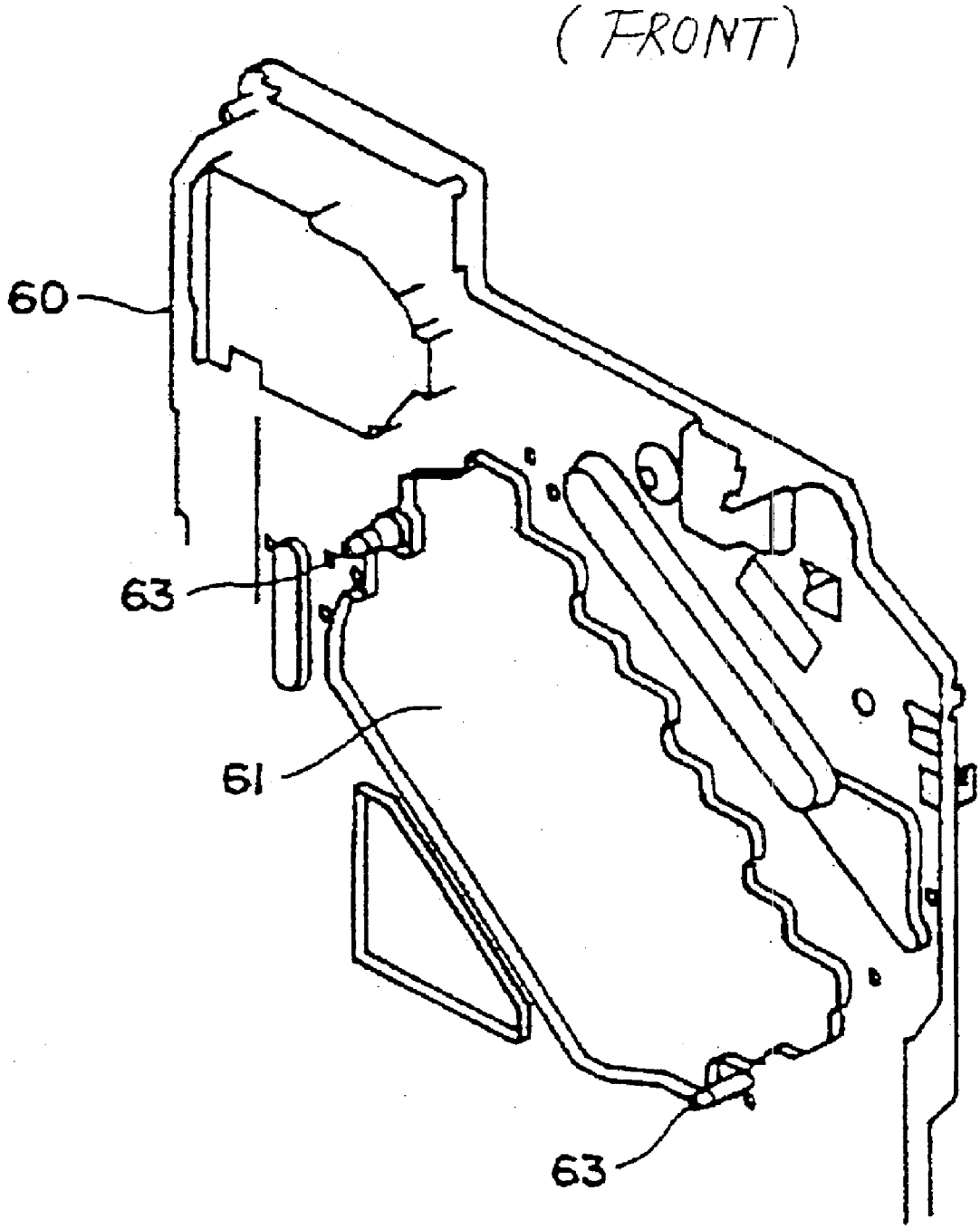
FIG. 5 is a perspective view showing a front side wall also included in the image forming apparatus, as seen from the inside.

As shown in FIG. 5, the front side wall 60 is formed with an obliquely extending opening 61. Two front reference pins 63 protrude inward from the inner surface of the side wall 60 at opposite sides of the opening 61.

As shown in FIG. 4, four unit support members 56 are mounted to the rear side wall 50. Each unit support member 56 includes a drum or image carrier support shaft 57, a developing unit positioning hole 58 positioned at a preselected distance from the support shaft 57, and a plurality of screw holes 59.

After bearings for the drum support shafts 57 have been fitted in the holes 51 of the rear side wall 50, the unit support members 56 are mounted to the outside of the rear side wall 50. Subsequently, a single set screw 64 is passed through the screw hole 53 of each unit support member 56 and one of the screw holes 53 of the rear side wall 50, thereby temporarily mounting the unit support member 56 to the side wall 50.

Figure 6:
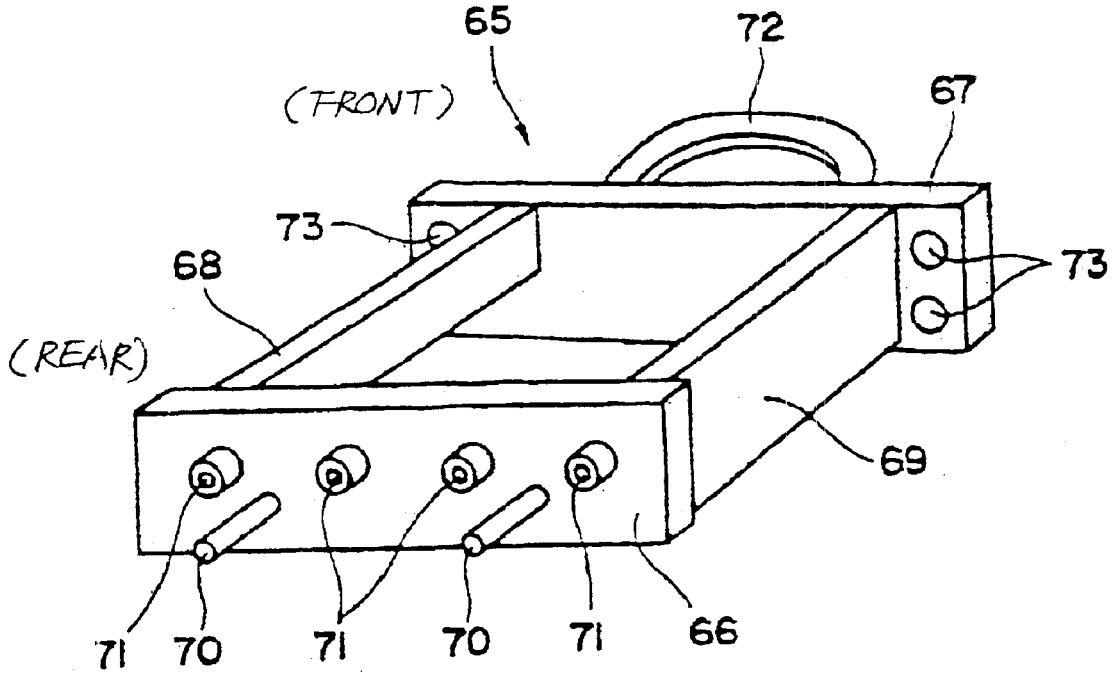
FIG. 6 is a perspective view showing the positioning jig in detail.

After the above step, a positioning jig 65 is inserted in the space between the front and rear side walls 60 and 50 from the front side. As shown in FIG. 6, the positioning jig 65 has a plurality of sheet metals 66 through 69 assembled in the form of a frame. The rear sheet metal 66 includes two rear reference pins 70 protruding outside and four support shaft holes 71 positioned side by side on a single virtual line. The front sheet metal 67 includes a knob 72 and two front reference pin holes 73 positioned at each end.

The drum support shafts 57 of the unit support members 56 each are fitted in one of the four support shaft holes 71 of the rear sheet metal 66. The rear reference pins 70 are inserted in the rear reference pin holes 54 of the rear side wall 50. On the other hand, the four front reference pins 63 of the front side wall 60 are inserted in the four front reference pin holes 73, so that the side wall 60 supports the jig 65 at the front side. As a result, the unit support members 56 are accurately positioned by the jig 65.

Subsequently, the set screws 64 inserted in the screw holes 53 all are driven home to thereby affix all of the four unit support members 56 to the rear side wall 50. Thereafter, the jig 65 is moved to remove the front reference pins 63 from the front reference pin holes 73. On the other hand, the drum support shafts 57 and rear reference pins 70 are pulled out of the support shaft holes 71 and rear reference pin holes 54, respectively. The jig 65 is then removed from the space between the front and rear side walls 60 and 50.

After the above step, a faceplate, not shown, is mounted to the rear side wall 50. The faceplate is formed with drum support shaft holes positioned side by side at preselected intervals and is formed with positioning pin holes positioned at a preselected distance from the above holes. At the rear side, the drum support shafts 57 each are inserted in a center hole formed in the rear flange of one of the drums 14. At the front side, each drum support shaft is inserted in one drum support shaft hole of the faceplate. As a result, the drum units 12 are supported between the front and rear side walls 60 and 50.

Figure 7:
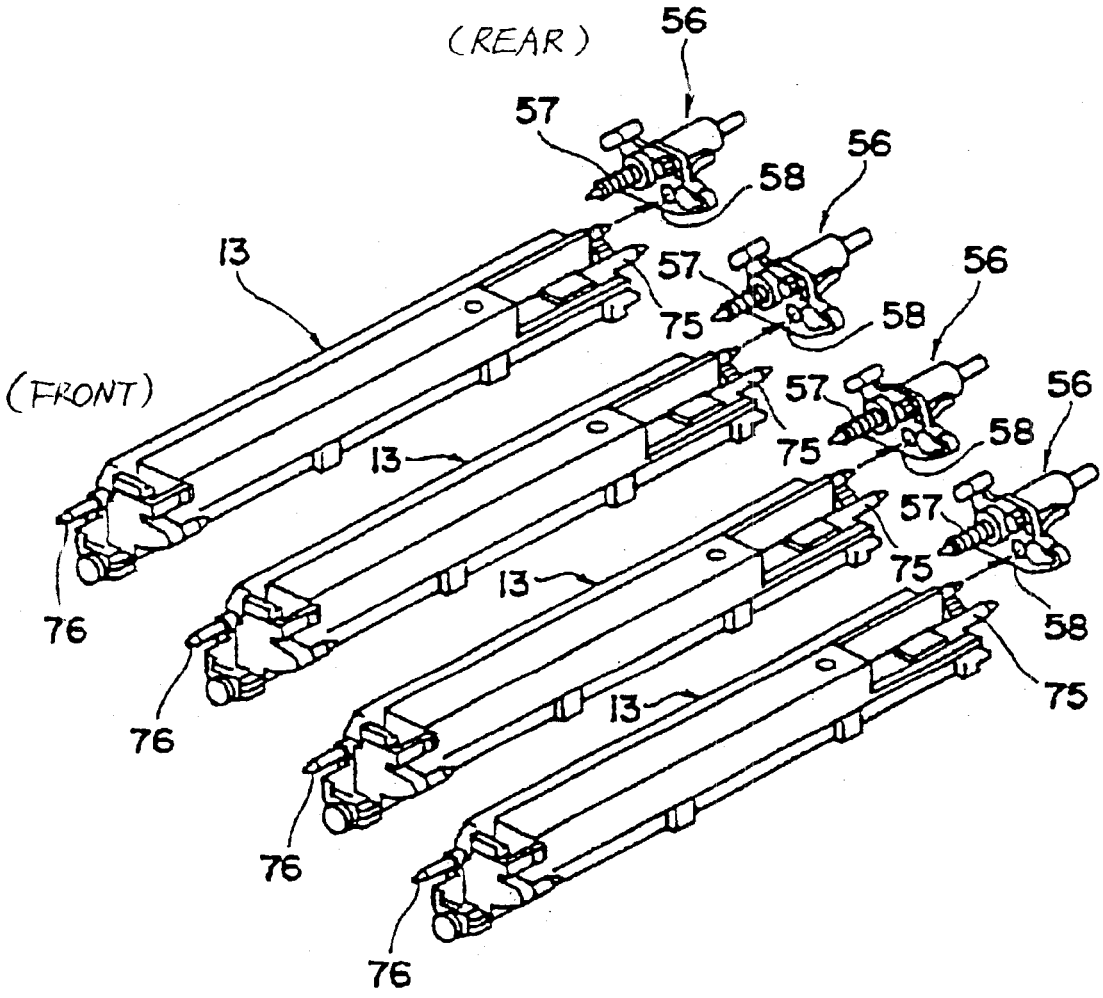
FIG. 7 is a perspective view showing the unit support members and developing units to be supported thereby.

Further, rear positioning pins 75 (see FIG. 7) studded on the developing units 13 each are inserted in one of the developing unit positioning holes 58 of the unit support members 56 via corresponding one of the holes 52 of the rear side wall 50. On the other hand, front positioning pins 76 (see FIG. 7) also studded on the developing units 13 each are inserted in one of the positioning pin holes of the faceplate. As a result, the developing units 13 are supported between the front and rear side walls 60 and 50. As shown in FIG. 7, the rear positioning pin 75 and front positioning pin 76 protrude outward from each developing unit 13 in alignment with each other.

By the procedure described above, the unit support members 56 are accurately positioned by the rear side wall 50 and jig 65 to thereby position the drum support shafts 57 parallel to each other. This accurately spaces the drum units 12 at a preselected distance. Also, the distance between each drum unit 12 and associated developing unit 13 is accurately set by the unit support member 56, thereby maintaining a gap for development constant. In this manner, the image forming means 10 are accurately positioned to obviate color shifts and irregular tonality, thereby enhancing image quality.

Figure 8:
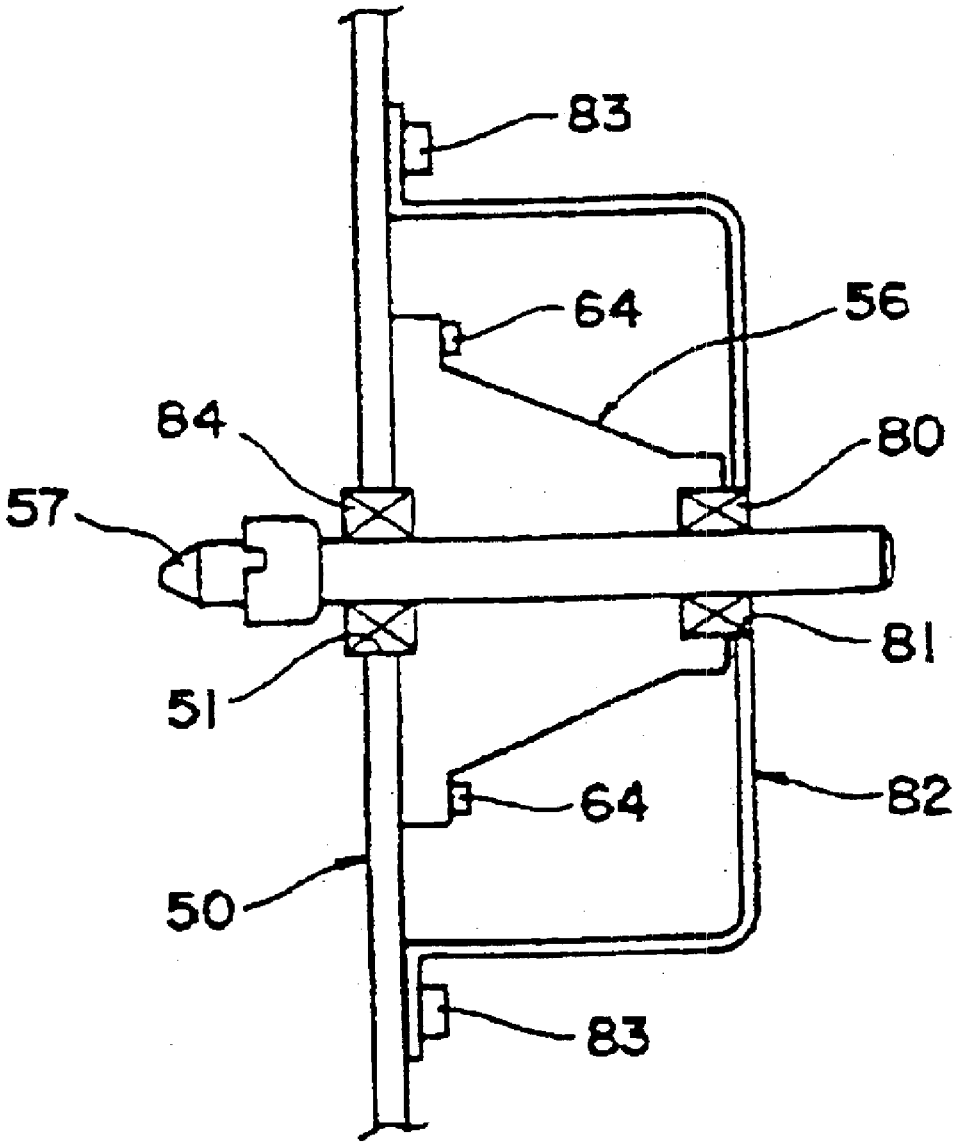
FIG. 8 is a section showing a modification of the illustrative embodiment.

In the specific procedure described above, after the jig 65 has been mounted to accurately position the unit support members 56, the screws 64 all are driven home to affix the unit support members 56. FIG. 8 shows an alternative arrangement for affixing the unit support members 56. As shown, after the unit support members 56 have been accurately positioned by the jig 65, a drive bracket or affixing bracket 82 is fastened to the outside of the rear side wall 50 by screws 83. The drive bracket 82 is formed with a hole 81 in which a ball bearing 80 included in each unit support member 50 is fitted. The drive bracket 82 reinforces the rear side wall 50 while firmly retaining the unit support members 56. Subsequently, the set screws 64 all are driven home for thereby affixing all of the unit support members 56.

As shown in FIG. 8, two bearings 80 and 84 rotatably support the drum support shaft 57. The bearing 84 is fitted in the hole 51 formed in the rear side wall 50.

Figure 9:
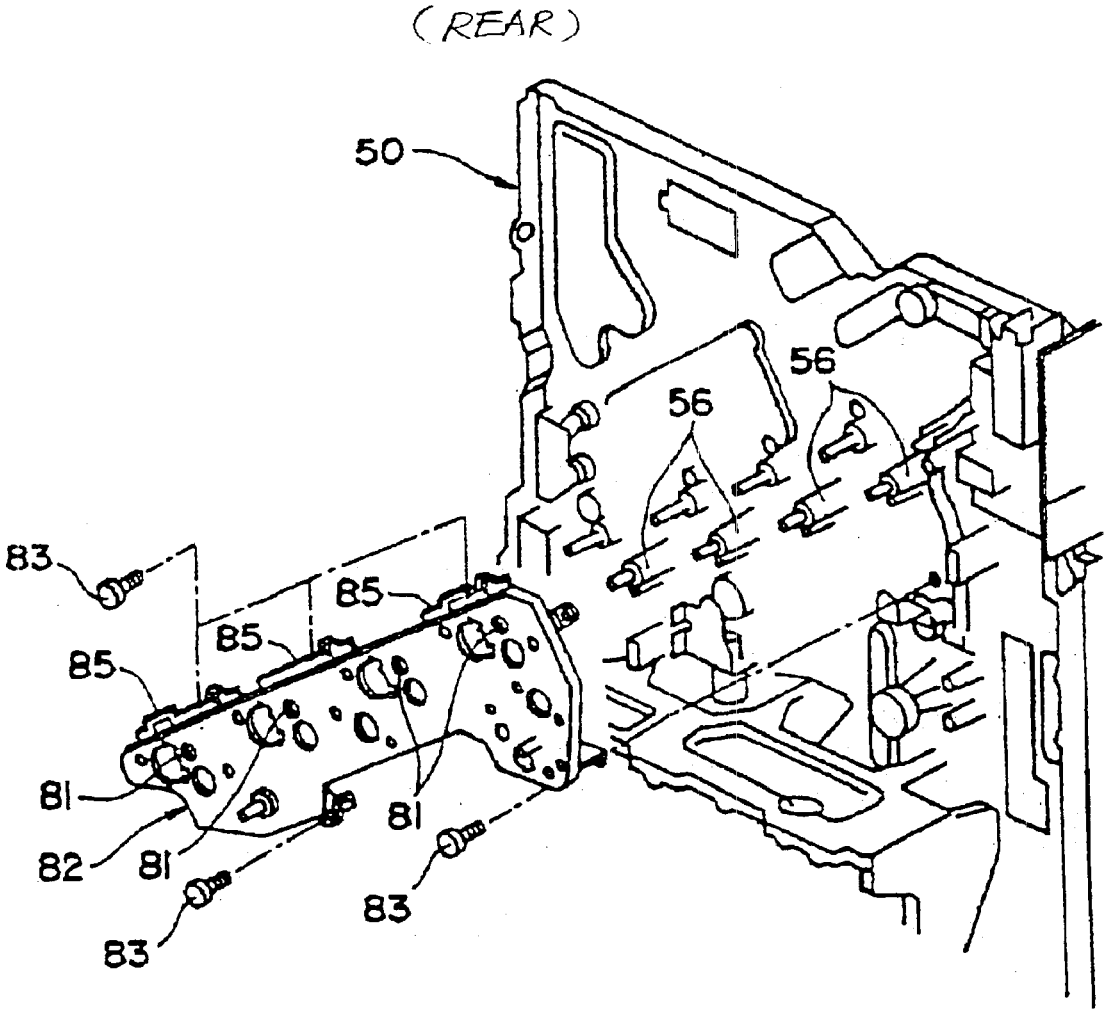
FIG. 9 is a perspective view showing the rear side wall and a drive bracket included in the modification of FIG. 8, as seen from the outside.

As shown in FIG. 9, the drive bracket 82 is implemented as an elongate plate bent to form a plurality of legs 85. Four holes 81 are formed in the drive bracket 82 side by side at preselected intervals. The legs 85 are fastened to the rear side wall 50 by screws 83.

In the alternative structure described above, the drive bracket 82 mounted to the rear side wall 50 further enhances the parallelism of the drum support shafts 57 and therefore makes the distance between the drum units 12 as well as the gaps for development more accurate.

In the above structure, to temporarily mount the unit support members 56 to the rear side wall 50, each bearing 84 is fitted in one of the holes 51 of the side wall 50. In an alternative structure, the holes 51 other than one positioned at the most downstream side in the direction of sheet conveyance may be implemented as slots. In this case, after one unit support member 56 has been affixed in the most downstream hole 51, the other unit support members 51 are loosely fitted in the other holes or slots 51, so that the distance between them is adjustable. Thereafter, the unit support members 51 all are affixed by using the most downstream hole 71, i.e., the most downstream unit support member 51 as a reference. This is also successful to enhance the accuracy of distance between nearby drum units 12 and to maintain preselected gaps for development.

It is to be noted that the present invention is similarly applicable to an image forming apparatus of the type transferring toner images from image forming means to an intermediate image transfer body one above the other and then transferring the resulting full-color image from the intermediate image transfer body to a sheet.

In summary, it will be seen that the present invention provides an image forming means positioning method and a jig therefor having various unprecedented advantages, as enumerated below.

(1) A positioning jig is positioned between opposite side walls and used to position a plurality of unit support members, so that the unit support members can be accurately positioned. This allows a plurality of image forming means to be accurately positioned relative to each other.

(2) After the unit support members thus positioned have been affixed to one of the side wall, the jig is removed, and then-drum units and developing units are mounted by being supported by the unit support members. The unit support members therefore accurately determine the distance between the drum units and the developing units, thereby maintaining gaps for development constant.

(3) After the unit support members have been temporarily affixed to the side wall, a positioning member is mounted between the side walls. The unit support members can therefore be easily handled.

(4) An affixing bracket is mounted to the side wall to support the unit support members while reinforcing the side wall. This further enhances accurate positioning of the unit support members and therefore the image forming means.

(5) The unit support members other than one located at the most downstream side in the direction of sheet conveyance are positioned by using the most downstream unit support member as a reference. This makes it needless for the side wall to accurately position the unit support members alone and thereby facilitates the fabrication of the side wall.

(6) After the jig has been mounted between the side walls, the unit support members to be temporarily mounted to the side wall are positioned. This also allows the image forming means to be accurately positioned relative to each other.

(7) The jig is removed after the unit support members have been affixed to the side wall, but before the drum units and developing units are mounted. The unit support members therefore accurately determine the distance between the drum units and the developing units, thereby maintaining gaps for development constant.

Various modifications will become possible for those skilled in the art after receiving the teachings of the present disclosure without departing from the scope thereof.

What is claimed is:

1. A method of positioning a plurality of image carrier units and a plurality of developing units by mounting said plurality of image carrier units and said plurality of developing units between a pair of side walls included in an image forming apparatus, said method comprising:

mounting a positioning jig between said pair of side walls to position a plurality of unit support members;

affixing said unit support members to one of said pair of side walls;

removing said positioning jig; and supporting said plurality of image carrier units and said plurality of developing unit with the unit support members.

2. The method as claimed in claim 1, further comprising:

affixing said unit support members to said one of the side walls before mounting said positioning jig between said pair of side walls.

3. The method as claimed in claim 2, further comprising:

mounting, after said unit support members have been positioned by said positioning jig, an affixing bracket to said one of the side walls and supporting said unit support members with the affixing bracket while reinforcing said one of the side walls; and affixing said unit support members to said one of the side walls.

4. The method as claimed in claim 3, further comprising:

positioning, by using one of said unit support members located at a downstream side in a direction of conveyance of a recording medium, a remaining one of the unit support members.

5. The method as claimed in claim 1, further comprising:

mounting, after said unit support members have been positioned by said positioning jig, an affixing bracket to said one of the side walls and supporting said unit support members with the affixing bracket while reinforcing said one of the side walls; and affixing said unit support members to said one of the side walls.

6. The method as claimed in claim 5, further comprising:

positioning, by using one of said unit support members located at a downstream side in a direction of conveyance of a recording medium, a remaining one of the unit support members.

7. In an image forming apparatus configured to position a plurality of image carrier units and a plurality of developing units by using a method to position the plurality of image carrier units and the plurality of developing units by mounting said plurality of image carrier units and said plurality of developing units between a pair of side walls, which are included in said image forming apparatus, said method comprising:

mounting a positioning jig between said pair of side walls to position a plurality of unit support members;

affixing said unit support members to one of said pair of side walls;

removing said positioning jig; and supporting said plurality of image carrier units and said plurality of developing unit with the unit support members.

8. The apparatus as claimed in claim 7, wherein said unit support members is affixed to said one of the side walls before mounting said positioning jig between said pair of side walls.

9. The apparatus as claimed in claim 8, wherein an affixing bracket is mounted, after said unit support members have been positioned by said positioning jig, to said one of the side walls to support said unit support members while reinforcing said one of the side walls, and said unit support members are affixed to said one of the side walls.

10. The apparatus as claimed in claim 9, wherein one of the unit support members is positioned by using another one of said unit support members located at a downstream side in a direction of conveyance of a recording medium.

11. A positioning jig in an image forming apparatus comprising:

a back member comprising at least one protrusion configured to be disposed in at least one void defined in a back wall of an image forming apparatus, the back member defining a plurality of voids configured to position a plurality of members in the image forming apparatus;

a front member disposed opposite the back member, the front member defining at least one void configured to receive at least one protrusion of a front wall of the image forming apparatus; and at least one side member connecting the back and front members.

12. The jig according to claim 11, wherein the front member comprises a handle.

13. The jig according to claim 11, wherein the at least one protrusion of the back member comprises two protrusions.

14. The jig according to claim 11, wherein the plurality of voids of the back member comprises four voids.

15. The jig according to claim 11, wherein the at least one void of the front member comprises at least two voids.

16. The jig according to claim 11, wherein the plurality of voids of the back member is configured to position a plurality of image forming units as the plurality of members.

17. The jig according to claim 11, wherein the plurality of voids of the back member is configured to position at least one of image carrier units and developing units as the plurality of members.

18. The jig according to claim 11, wherein the at least one side member comprises two side members.

19. A method of positioning image carrier units in an image forming apparatus, comprising:

disposing a jig between first and second walls of the image forming apparatus to position first and second support members;

connecting the support members to the first side wall; and supporting one of an image carrier and a developing unit with the first and second support members after removal of the jig.

20. The method according to claim 19, wherein the first support member supports a first image carrier and a first developing unit and the second support member supports a second image carrier and a second developing unit.

* * * * *